United States Patent [19]

Nash

[11] Patent Number: 4,943,219

[45] Date of Patent: Jul. 24, 1990

[54] HOLLOW CORE CONCRETE EXTRUDER

[75] Inventor: Richard C. Nash, New Prague, Minn.

[73] Assignee: Fabcon, Inc., Savage, Minn.

[21] Appl. No.: 385,785

[22] Filed: Jul. 27, 1989

[51] Int. Cl.[5] ..... B28B 1/14

[52] U.S. Cl. ..... 425/64; 249/105; 425/120; 425/253; 425/256; 425/DIG. 118

[58] Field of Search ..... 425/64, 120, 219, 224, 425/456, 261, 257, 259, 253, 256, DIG. 118; 249/108, 105, 109; 264/69–72, 263; 222/547, 564

[56] References Cited

U.S. PATENT DOCUMENTS

| | | | |
|---|---|---|---|
| 2,833,019 | 5/1958 | Dench et al. | 425/DIG. 118 |
| 2,932,875 | 4/1960 | Butcher | 425/64 X |
| 3,217,375 | 11/1965 | Kinnard | 425/64 X |
| 3,830,606 | 8/1974 | Breitfuss | 425/64 X |
| 4,045,528 | 8/1977 | Urmanov | 264/69 |
| 4,369,153 | 1/1983 | Nash | 425/64 X |

*Primary Examiner*—Richard L. Chiesa
*Attorney, Agent, or Firm*—Vidas & Arrett

[57] ABSTRACT

An improved slipform for use in a machine for casting hollow core concrete planks includes at least one angled baffle plate in the core material receiving ports so as to deflect the core material from directly impacting the lower concrete. This lessens the possibility of tears and holes in the lower layer caused by the core material.

5 Claims, 1 Drawing Sheet

HOLLOW CORE CONCRETE EXTRUDER

BACKGROUND OF THE INVENTION

1. Field of the Invention

This invention relates to improvements in a machine for casting concrete panels in a single pass casting operation utilizing slip forms to fit core areas within the panel with core material which can be dumped from the cores after preliminary curing of the panel.

2. Description of the Related Art

U.S. Pat. No. 4,369,153 which issued Jan. 18, 1983 to Nash et al discloses a machine which casts hollow core concrete panels in a single casting operation utilizing a slip form technique to fill cores with core material which can be dumped from the core after curing of the concrete has been accomplished. U.S. Pat. No. 4,369,153 is incorporated herein by reference.

In single casting operations, hollow core concrete panels are formed on a moving bed in which concrete is first poured around the front end of a slip form which forms the bottom layer of the concrete panel. The bed past the slip forms the bottom layer of the concrete panel. As the concrete travels on the bed past the slip form core material which may be an aggregate, is fed into openings in the slip form to fill the desired cores with core material.

Unfortunately, as the core material is poured into the slipform, the lower concrete layer is severely buffeted by the falling core material. This buffeting may cause stretch marks or tears in the lower layer of concrete which are unacceptable in the finished product.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. {1.56(a) exists.

SUMMARY OF THE INVENTION

An improved slipform for forming hollow core concrete panels is created by placing one or more angled baffle plates in the slipform feed chutes. The baffle plates deflect the falling core material, directing it at an angle toward the lower concrete layer. The core material falls on the uncured concrete with less force without decreasing the flow rate of the core material. The entire casting process of the concrete panel is able to continue at the same rate with fewer tears or holes in the lower concrete layer from the core material.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 1:
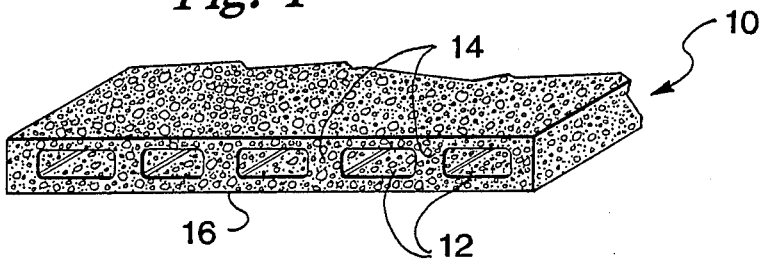
FIG. 1 is a fragmentary perspective view of a typical hollow core concrete panel.

With reference to the Figures it will be seen that the slipform frame 100 of the invention consists of a plurality of slipforms or extruders 128. Like reference numerals are used herein as in U.S. Pat. No. 4,369,153 which disclosure is incorporated herein by reference. As the casting machine (not shown) is operated the slipform frame 100 moves through the concrete deposited from a hopper and commences the forming of voids in the product being formed on the casting bed.

Figure 2:
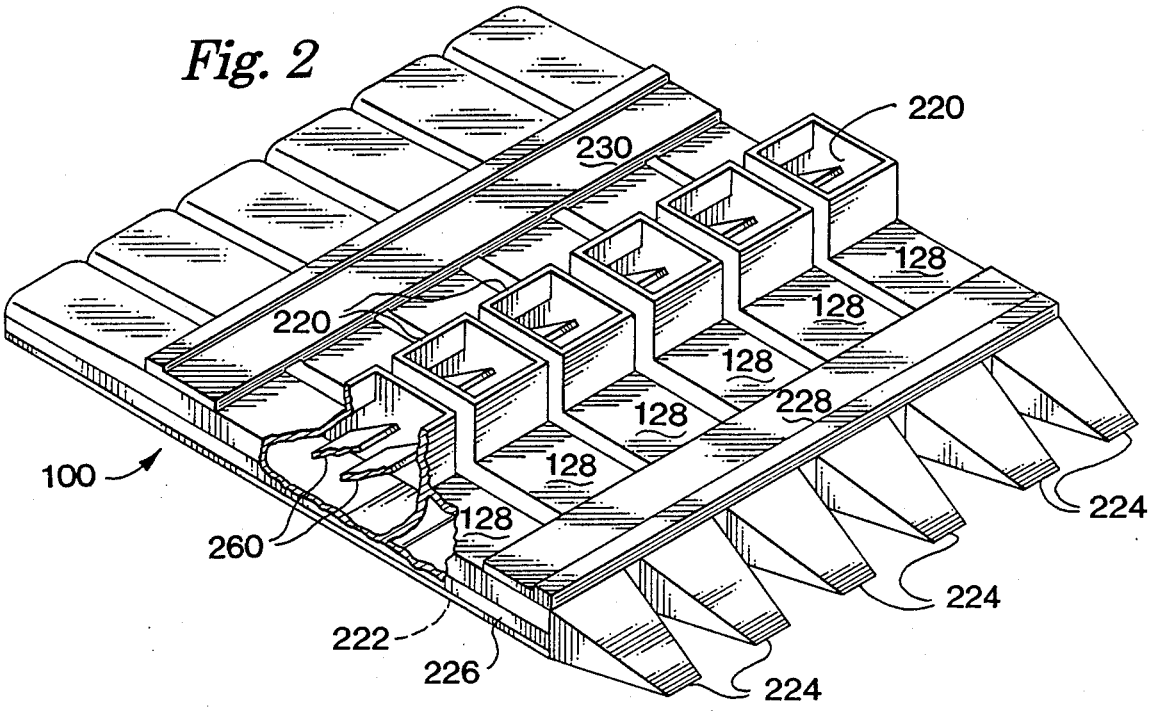
FIG. 2 is a perspective view of a core former assembly with parts cut away.
Figure 3:
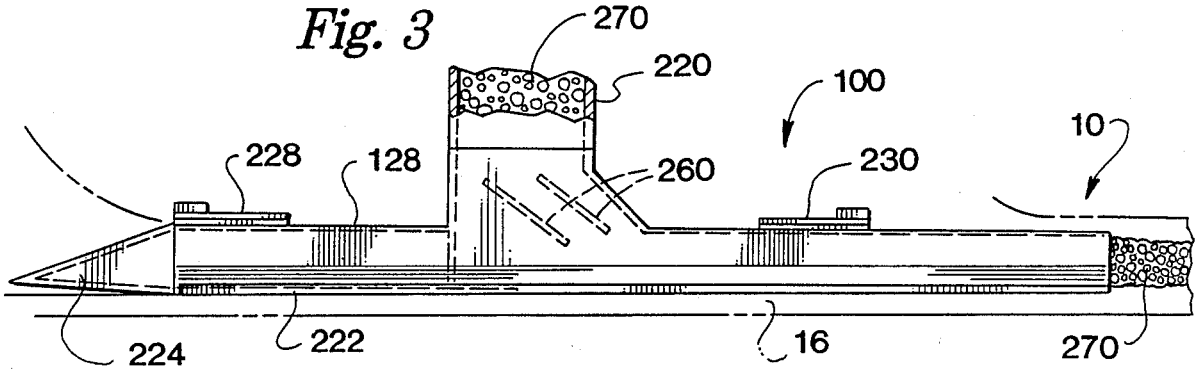
FIG. 3 is a side elevational view of the core former with parts cut away, other elements shown in phantom line.

The structure of slipform frame 100 is shown in FIGS. 2 and 3 where a plurality of slipforms 128 are joined together for forming a six void plank. The height of the slipforms can be varied in order to manufacture planks with varying depths and core sizes. In order to change the size of core or change slipforms, the slipforms are disconnected from the beams by disconnecting bolts.

Each of the slipforms 128 has a central core material receiving opening or port 220 which communicates with the lower opening of a core material hopper to receive a supply of core material therefrom. The portion of the slipform 128 in front of the port 220 has a closed bottom surface 222 as shown in FIGS. 2 and 3. The extreme front end of the slipform 128 has a wedge shaped plow portion 224 having a reduced cross sectional area. The parallel side walls 226 of the slipform 128 converge in the wedge shaped section. The front of each slipform 128 acts to form a void by packing concrete deposited from a hopper, through which the slipforms are forced, upwardly, downwardly and to both sides of the slipform tip 224. The portion of the slipform behind the tip and in front of the core material receiving port 220 supports the concrete in the shaped configuration to stabilize it. Vibration of the slipform frame tends to facilitate packing of the concrete to form well-defined hollow cores which are then filled with core material from the remainder of the trailing portion of the slipforms.

The slipform sections 128 are joined together by forward and rear support members 228 and 230. The rear portion of the slipform from port 220 has a completely open bottom to allow the core material to contact the surface of the packed concrete from the hopper and to facilitate the flow of core material into the interior void in the plank formed by the closed section of the slipform 128. Vibration of the slipform facilitates the flow of the core material as well as packing the concrete and elimination of unwanted voids.

The length of the slipform from the core port 220 to the rear portion of the extruder permits core material and concrete voids to stabilize and supports the core opening as additional concrete is poured around the slipform by a rear hopper which dumps concrete on the tail or trailing portion of the slipform. The tail portion 232 of the slipform has a top surface which tapers downwardly to slightly reduce the cross sectional area of the void portion to slightly compress or consolidate the core material as it leaves the slipform to form well-defined cores in the product.

The height of the core portion in an eight inch deep product is about six inches, while the height of the void in the twelve inch product is about ten inches.

FIG. 1 shows a typical hollow core concrete plank 10 which includes a plurality of hollow cores or voids 12. Between each hollow core 12 are webs of concrete 14 which are formed between adjacent slipforms 128. The lower concrete layer 16 is the portion of concrete which could be damaged with prior slipform designs.

The improved slipform frame 100 of the invention includes at least one and preferably two baffle plates 260 attached to opposing side walls of the core receiving ports 220 of the slipforms. As shown, the baffle plates are angled downwardly toward the rear of the slipform to direct core material onto the concrete layer 16. Falling core material is directed past partial floor 222 of the slipform and onto the lower concrete. The angled baffle plates 260 are preferably at an angle of about 50 to about 62 degrees from the horizontal plane defined by the lower surface of the slipform 128. Most preferably, the baffle plates are set at an angle of about 56 degrees. Shallower angles tend to decrease the flow rate of the core material to an unacceptable level, while steeper angles do not provide as much of the desired deflection.

Falling core material 270 strikes the baffle plates and is deflected back into the slipform, striking the lower concrete layer at an angle. This redirection causes far less damage to the lower concrete layer by the core material. Part of the kinetic energy is absorbed by the baffle plates and the vectors of force are directed such that the core material does not cause tears or holes in the concrete.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. In a slipform frame for use in forming concrete panels on a casting pallet which includes a floor and a pair of parallel side walls, said slipform frame having at least one slipform suspended therefrom above the floor and between the side walls of said casting pallet, each of said slipforms having a pair of side walls and a top surface, each of said slipforms having a core shaping material receiving port located in the top surface thereof between front and rear portions thereof, the front portion of each of said slipforms having a closed bottom, while the remainder of said slipform has an open bottom, said slipform also including a closed extreme front portion in which the side walls and top and bottom surfaces of said slipform are tapered inwardly to form a markedly reduced cross sectional closed end; the improvement comprising:

at least one baffle plate member fixedly positioned within each of said core shaping material receiving ports at an angle such that core material entering said port is deflected toward the rear of said slipform.

2. The slipform frame of claim 1 wherein each of said baffle plates consist of a plate extending across the port and angled downwardly at an angle of about 50 to 62 degrees from horizontal toward the rear of said slipform.

3. The slipform frame of claim 1 wherein each of said baffle plates is angled downwardly in said ports at an angle of between about 50 and about 62 degrees from horizontal such that said plates direct core material toward the rear of said slipform.

4. The slipform frame of claim 1 in which each of said slipforms include two spaced baffle plates, each of which is angled downwardly toward the rear of said slipform frame at an angle of between about 50 and about 62 degrees from horizontal.

5. In a machine for casting concrete panels on a casting pallet, including a floor and a pair of parallel side walls, said machine comprising a frame, a slipform frame having at least one slipform suspended therefrom above the floor and between the side walls of said casting pallet, each of said slipforms having a pair of side walls and a top surface, each of said slipforms having a core shaping material receiving port located in the top surface thereof between front and rear portions thereof, the front portion of each of said slipforms having a closed bottom, while the remainder of said slipform has an open bottom, said slipform also including a closed extreme front portion in which the side walls and top and bottom surfaces of said slipform are tapered inwardly to form a markedly reduced cross sectional closed end; the improvement comprising:

at least one baffle plate member fixedly positioned within each of said core shaping material receiving ports at an angle such that core material entering said port is deflected toward the rear of said slipform.

* * * * *